US006389627B1

(12) United States Patent
Annen

(10) Patent No.: US 6,389,627 B1
(45) Date of Patent: May 21, 2002

(54) DYEING PROCESS

(75) Inventor: Oskar Annen, Aesch (CH)

(73) Assignee: Clariant Finance (BVI) Limited, Tortola (VG)

( * ) Notice: Subject to any disclaimer, the term of this patent is extended or adjusted under 35 U.S.C. 154(b) by 0 days.

(21) Appl. No.: 09/509,451

(22) PCT Filed: Oct. 15, 1996

(86) PCT No.: PCT/EP96/04479

§ 371 Date: Dec. 11, 2000

§ 102(e) Date: Dec. 11, 2000

(87) PCT Pub. No.: WO97/14840

PCT Pub. Date: Apr. 24, 1997

(30) Foreign Application Priority Data

Oct. 16, 1995 (GB) ..... 9521113

(51) Int. Cl.[7] ..... D06B 3/30; D06B 21/00

(52) U.S. Cl. ..... 8/158; 68/26

(58) Field of Search ..... 8/158, 159; 68/12.07, 68/12.12, 26, 27

(56) References Cited

U.S. PATENT DOCUMENTS

| | | | | |
|---|---|---|---|---|
| 3,919,864 A | * | 11/1975 | Pellerin | 68/12.07 |
| 4,111,645 A | * | 9/1978 | Zurbuchen et al. | 8/159 X |
| 4,395,789 A | | 8/1983 | Bruce | |
| 5,030,242 A | * | 7/1991 | Bellaire | 8/158 X |

* cited by examiner

*Primary Examiner*—Philip R. Coe
(74) *Attorney, Agent, or Firm*—Krishna Banerjee

(57) ABSTRACT

A dyeing process comprising a number of liquid treatment steps such as washing and rinsing, after the application of the dyeing liquor to the textile, the fabric being centrifuged after each treatment step; and a centrifuge adapted for carrying out the centrifugation.

3 Claims, 5 Drawing Sheets

DYEING PROCESS

BACKGROUND OF THE INVENTION

This application relates to a dyeing process and more particularly to after-dyeing treatment of fabric.

In conventional fabric or textile dyeing processes, dyeing is followed by a treatment regime which generally consists of one or more treatment baths, the purpose of this being the removal of excess dyestuff (which has not adhered to the fabric), the further treatment of the fabric (for example, by fixing agents for those dyes which require it, or by such materials as fabric softeners) or the removal of residual materials remaining after a treatment (for example, fixing agent or fabric softener). A conventional dyeing process without chemical treatments such as fixing and softening typically comprises the following sequential steps: dyeing in a dye bath, transfer to a first rinse bath (where the material is rinsed with water), transfer to a second rinse bath, transfer to a first soap bath (where the material is washed with soap solution), transfer to third and fourth rinse baths and a final drying step in a centrifuge. The whole procedure is conventionally carried out on a dyeing machine in which the dyeing was carried out, transfer to the centrifuge only being carried out for the particular purpose of centrifuging.

Recent developments in dyeing processes have been concerned with decreasing the liquor to goods ratio employed in the dyeing step. Generally a lower liquor to goods ratio results in a more effective dyeing. However, it has been observed that in conventional processes, even with low liquor to goods ratios, for example, a liquor to goods ratio in the range of from 20:1 to 5:1, a significant amount of the liquor is transferred from a dye bath to the next treatment step, which may be a rinse bath, a wash bath or some other treatment bath. This transfer continues in succeeding stages, the amount of liquid being transferred depending on the liquid up-take of the particular fabric (for example, knitted fabrics have a greater up-take than woven goods). Knitted cotton (cotton interlock) which typically has a liquid up-take of 250% by weight transfers up to a quarter of a dyeing liquor having a liquor to goods ratio of 10:1 to the next processing stage. An even greater transfer occurs with a smaller liquor to goods ratio.

It follows that this transfer of liquid reduces efficiency considerably. As a result, the potential effect of the particular processing stage, be it rinsing, washing, fixing, softening or other effect, of the bath is decreased. Thus, more washing procedures are required in order to arrive at a fabric having the desired level of freedom from undesirable materials such as excess dyestuff or other impurities (such as process chemicals). The increase in number of washing procedures required, means an increase in one or more of the overall water consumption, overall time requirement and overall energy consumption for the process. This in turn increases the cost of production and the cost to the consumer. So far, it has not proved possible to improve the conventional methods to any great extent.

BRIEF SUMMARY OF THE INVENTION

The present invention provides a dyeing process, which comprises the steps of applying a dyeing liquor to a fabric to be dyed, and thereafter subjecting the fabric to a treatment regime, which comprises a series of liquid bath treatment steps, characterized in that the fabric is subjected to centrifugation after each such treatment step.

DETAILED DESCRIPTION OF THE INVENTION

Figure 1:
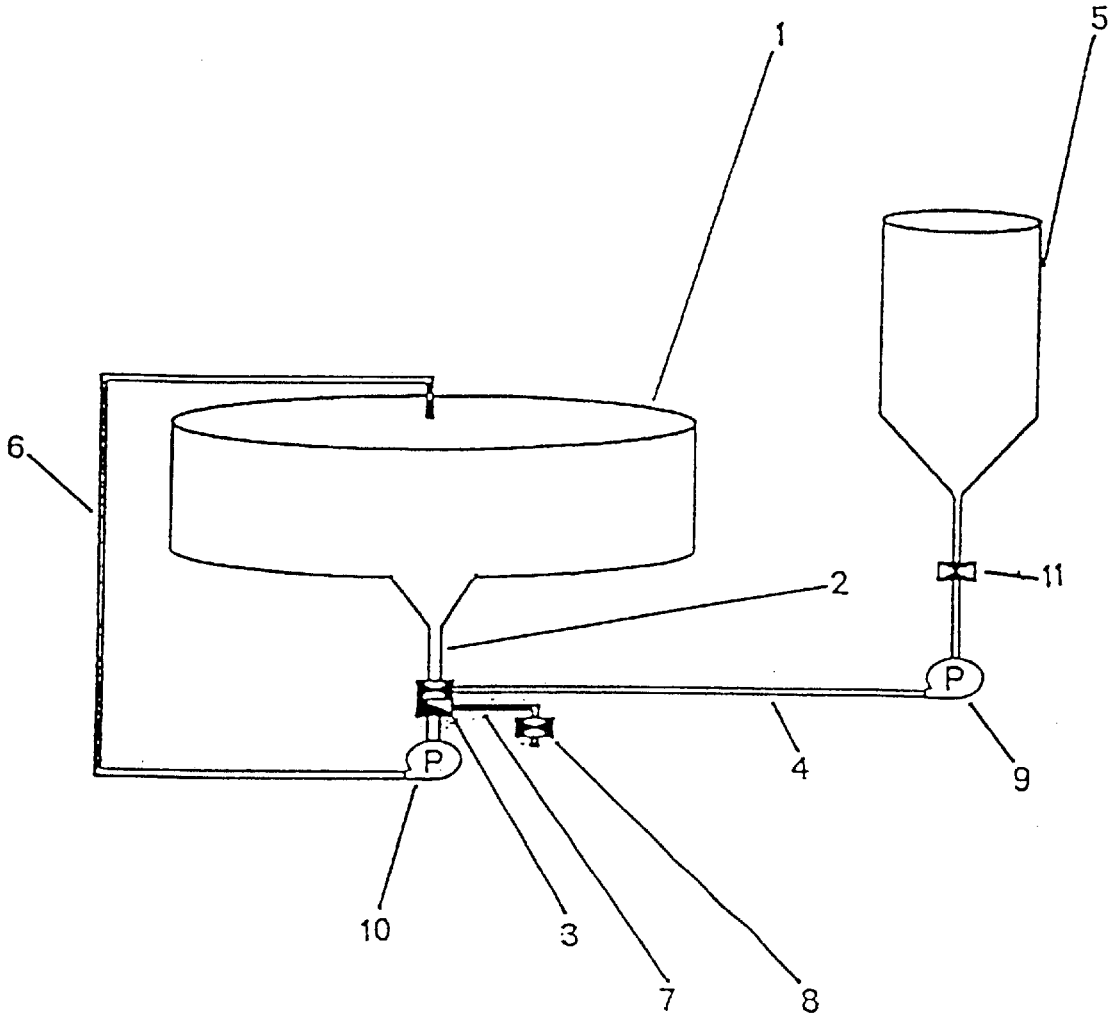
FIG. 1 is a schematic representation of an apparatus useful in the present invention

It has now been found that it is possible to dye materials such that a dyeing as good as any conventional dyeing is obtained, and such that the drawbacks of the conventional processes hereinabove described are at the same time greatly minimised. Accordingly the present invention provides a dyeing process which comprises the steps of applying a dyeing liquor to a fabric to be dyed, and thereafter subjecting the fabric to a treatment regime which comprises a series of liquid bath treatment steps, characterised in that the fabric is subjected to centrifugation after each such treatment step.

The dyeing liquor is any dyeing liquor which has been prepared using one or more suitable dyestuffs, according to conventional methods. Suitable dyestuffs include dyestuffs selected from the group consisting of direct dyes, reactive dyes and sulphur dyes and are well known to one skilled in the art. The liquor to goods ratio may be varied as desired. Typically, a liquor to goods ratio in the range of from 20:1 to 5:1 is employed. A liquor to goods ratio of 4:1 may also be used, in which case a suitable dyeing machine such as an air-flow jet dyeing machine is employed.

By "liquid bath treatment step" is meant, for the purposes of this invention, a treatment step wherein the material is immersed in a treatment liquid until the treatment is finished to an acceptable degree or to the maximum attainable degree. Such treatment steps include washing steps (with soap solution), rinsing steps (with water), fixing steps (with fixing agents, for those dyes which need such fixing) and various other chemical treatments, such as softening. A centrifugation step is carried out after each such step of the procedure. The most practical means of achieving this is by carrying out the entire treatment regime after dyeing and up to final drying in a centrifuge. This is a major departure from the known art in which all treatment is generally carried out in a dyeing machine, with any centrifugation being carried out at the end before final drying. It has major ramifications in that it not only allows the benefits of the present invention which shall be further detailed hereinunder, but it also frees a specialised dyeing machine for further dyeing and therefore leads to further economies.

The centrifuge may be any such apparatus known to the art, and the skilled person may select any of the wide range commercially available. For the purposes of this invention, the centrifuge is modified so that it is suitable for its dual role as a treatment vessel. This necessitates a valve which retains the liquid in the centrifuge (rather than the usual practice of allowing it to run out). When the valve is closed, liquid is retained in the centrifuge and when it is open liquid leaves the centrifuge. Also required are means for supplying the centrifuge with the materials needed for each stage, for example, wash water, soap solution, treatment liquids (such as fixing agent and fabric softener) and so on. These may already be available for supply to the centrifuge (for example, hot water from a heat exchanger used with other equipment) and the skilled person will readily appreciate the different possibilities of providing such things. If they are not readily available, a further embodiment of the invention consists of the association with the centrifuge of a storage tank which is connected to the centrifuge by a conduit and which is adapted to hold the liquid for the next treatment step ready for feeding into the centrifuge once it has been emptied of the previous treatment liquid. Thus, in a process involving a rinse step followed by a wash step, the holding tank could be filled with soap solution while the rinse step is proceeding. The holding tank may be fitted with heating elements, so that the treatment liquid awaiting use may be heated to whatever temperature is necessary. A further addition to the centrifuge is a recycling facility so that, when a treatment step is, taking place (agitation being achieved by slow rotation of the centrifuge), the treatment liquid may be continuously recycled through the centrifuge. Such means may be easily provided by the skilled person. When a given process step is finished, the material is centrifuged and the treatment liquid allowed to run out in the conventional fashion by opening the retaining valve. When centrifugation is finished, the valve is closed and the liquid for the next treatment stage is added.

The use of centrifugation ensures that much of the liquid is removed prior to the next treatment step—typically 70% liquid by weight of the goods remains. This means that the next treatment step will suffer much less contamination from the retained treatment liquid than would be the case for conventional treatment regimes, and consequently fewer rinses are necessary.

A typical dyeing process according to the present invention comprises the following sequential steps: dyeing; a centrifugation step; a rinse bath step (with water); a centrifugation step; a soap bath step (with soap solution); a centrifugation step; a rinse bath step (with water); and a centrifugation step; the dyeing taking place in a conventional dyeing machine and the subsequent steps taking place in the centrifuge as hereinabove described.

The advantages of the invention are numerous. The removal of liquid by centrifugation means that, as mentioned hereinabove, there is less contaminant to be passed on to a succeeding treatment step. In practice, this means a greatly reduced number of wash steps, something of major importance in the many countries where water is expensive. In addition, there is a concomitant reduction in energy needs, labour costs and machine time, not to mention the more efficient use of machinery. The total savings can be as high as one-third of total costs. The equipment useful in the method of the invention is commonplace in the industry and can be readily modified for the purposes of the invention.

The method of the invention may be used in connection with any dyeing process, but it is particularly efficacious in the dyeing of cellulosic materials such as cotton, which for the purposes of the invention are the preferred materials.

The invention is further described with reference to the accompanying drawing which schematically represents an apparatus of the type useful in the present invention. Accordingly, the present invention further provides a treatment vessel comprising a centrifuge having a valve for retaining a treatment liquid within the centrifuge, the centrifuge having in association therewith a storage tank which is connected to the centrifuge by a conduit, the storage tank being adapted to hold a treatment liquid ready for feeding into the centrifuge once it has been emptied of the previous treatment liquid.

According to one embodiment of the treatment vessel, there is provided a centrifuge 1 which rotates about a vertical axis and has an outlet conduit 2 which comprises a valve assembly 3. This valve assembly has three connection possibilities, via a conduit 4 to a storage tank 5 which is equipped with heating elements, to a recycling loop 6 and to a drain outlet 7 which has its own drain valve 8, pumps 9 and 10 moving respectively liquid from the storage tank to the centrifuge 1 and around the recycling loop 6, the storage tank being isolatable from the valve assembly by a valve 11.

It will be understood by the skilled person that many variations of the above configuration are possible, all of them within the scope of this invention. For example, as previously mentioned, hot water may be brought directly from a heat exchanger, without the need for a storage tank. The invention can also work with a drum-type (horizontal axis) centrifuge, although this arrangement has certain technical drawbacks.

In a typical operation, the dyed material is removed from the dyeing machine and loaded into the centrifuge 1 and centrifuged for 5 minutes to remove as much dyeing liquor as possible. Warm rinse water is then pumped by the pump 9 from the storage tank 5 through the conduit 4 to the centrifuge and the valve assembly configured to close off the conduit 4. The centrifuge 1 is rotated slowly to allow the rinse water to permeate the material and remove excess dye and other chemicals present. During this time, the valve assembly 3 is configured such that the wash water is pumped continuously by pump 10 through the recycling loop 6 which serves to keep the liquid in the centrifuge homogeneous. Also during this time, soap solution for a wash stage is added to the storage tank 5 (valve 11 having been closed), heated to 98° C. and held in readiness. When sufficient time has passed (this depends on a number of factors such as nature of material and machine size, but 10 minutes is usually sufficient), the valve assembly 3 is operated such that the recycling loop 6 is closed and the path to the drain outlet 7 is opened with the drain valve 8 also being opened. The centrifuge 1 is rotated at centrifuging speed until the excess liquid has been completely removed (typically about 5 minutes). The centrifuge is then stopped and the valve assembly 3 is reconfigured to close off the drain outlet 7 (the drain valve 8 also being closed), and to allow the hot soap solution to be pumped in from storage tank 5 when valve 11 is opened. The process is then repeated, and this can be done for as many times as there are stages. Finally, the material is removed and dried conventionally, for example, by evaporation.

Dyeings in which a process according to the invention has been employed suffer no disadvantages in comparison with those made using conventional techniques. In particular, when a comparison between the perspiration fastness, rubbing fastness and wash fastness of fabrics dyed using a reactive dye according to the process of the present invention and a conventional dyeing process is made, those subjected to the method of the present invention are found to be at least as good.

EXAMPLES

The process of the invention is further illustrated by the following non-limiting examples. It will be understood that depending on the particular means of heating and cooling used in the process, will affect the period of time required for each step. In the following examples the heating and cooling means are those conventionally used in the dyeing industry. All temperatures are given in degrees Celsius.

Example 1

Process According to the Invention

Figure 2:
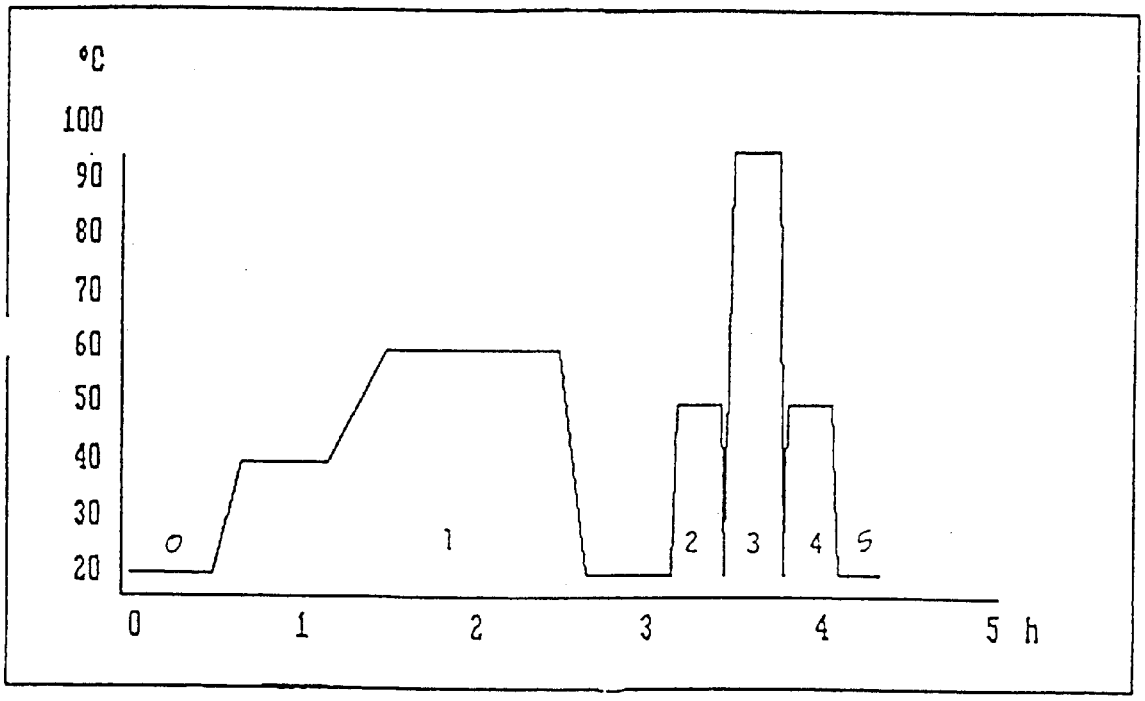
FIG. 2 is a temperature vs. time curve for the process of the present invention, described in Example 1

The process according to this example is illustrated in FIG. 2. In FIG. 2, the numbers 0 (above) and 1–5 (under) the curves, correspond to the following steps 0–5;

Step 0

A sample of 500 Kg prebleached cotton interlock material is loaded onto the dyeing apparatus which is an overflow dyeing apparatus (an "Eco-Soft" (trade mark) ex Thies, Germany). The loading time is 0.5 h.

Step 1

10 Kg C.I Reactive Red 123 is added to 5000 L water, together with 60 g/L Glaubers salt and 2.5 g/L soda ash, to give a dyeing liquor and the fabric is dyed for 2.25 h.

Step 2

The fabric is loaded into a centrifuge, loading time being 0.5 h (a 500 Kg capacity machine) equipped as shown in the drawing, where it is centrifuged, the run-off leaving the washing vessel via the drain outlet 8. It is then rinsed by the addition of 5000 L wash water at 50° C. for 10 minutes, this having been waiting in readiness in the storage tank. During this rinsing procedure, the valve assembly 3 is configured such that the wash water is pumped continuously by pump 10 through the recycling loop 6 which serves to keep the liquid in the centrifuge homogeneous. During the rinse procedure, the storage tank is replenished with 5000 L of a soap solution at 95°, in readiness for use in the next stage. The duration of this step, namely the centrifugation and rinsing procedure is 0.33 h.

Step 3

The fabric is centrifuged. Thereafter, the soap solution at 98° is added to the centrifuge and agitated there for 10 minutes. The soap solution is allowed to cool to 70°. During this time, the storage tank is replenished with 5000 L of rinse water at 50° for a further rinsing (see Step 4). The duration of this step namely the centrifugation and washing procedure is 0.33 h.

Step 4

The rinse procedure of Step 2 is repeated, i.e. centrifugation and rinsing take place as described under Step 2 above. Where desired a cationic softening agent may be present in the rinse water. The duration of this step, namely the centrifugation and rinsing procedure is 0.33 h.

Step 5

The fabric is centrifuged for 10 mins., removed from the centrifuge and dried according to conventional methods.

The total process time of the above described process (excluding the drying step) is ca. 4.7 hours.

Example 2

Conventional Dyeing Process.

Figure 3:
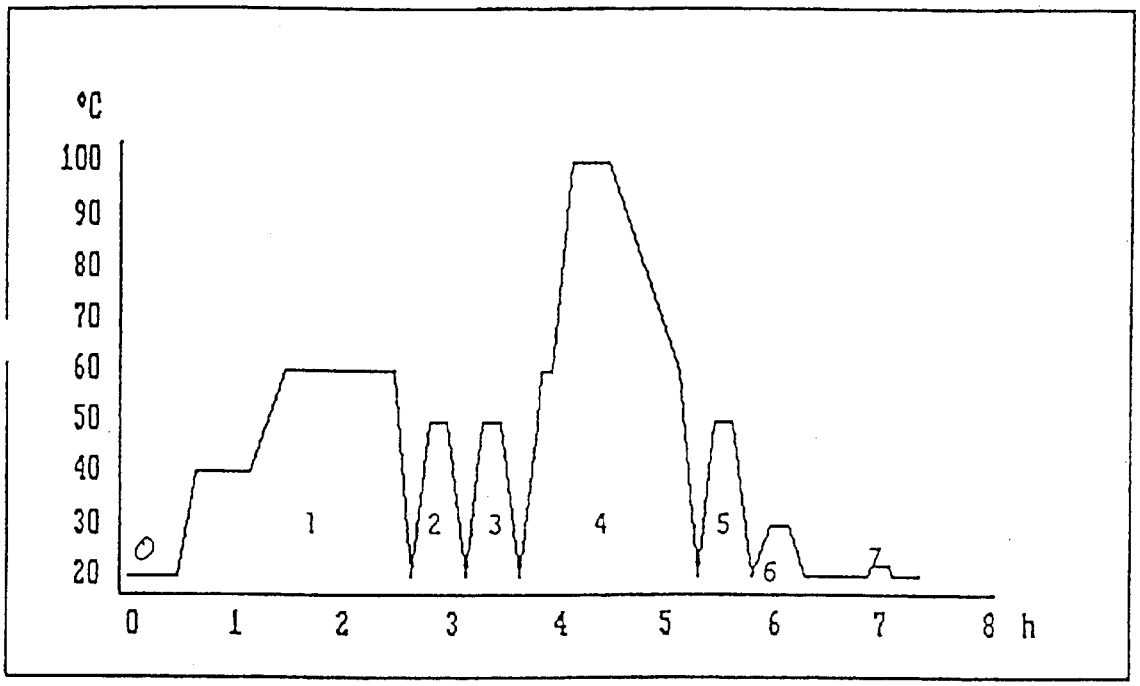
FIG. 3 is a temperature vs. time curve for a conventional drying process, described in Example 2

The process according to this example is illustrated in FIG. 3, in which the numbers either over or under the curves have the following meanings:

0 is loading the dyeing apparatus 1 is dyeing 2 is rinsing (water)

3 is rinsing (water)

4 is washing (soap bath)

5 is rinsing (water)

6 is rinsing (water) and 7 is centrifugation.

Step 0

Step 0 of Example 1 above is repeated.

Step 1

Step 1 of Example 1 above is repeated.

Step 2

There is added to the apparatus 5000 L of a rinsing bath of water at 50°. The dyeing apparatus is then operated for 10 minutes and the rinse water is drained off.

Step 3

5000 L water at 50° is added to the apparatus, the rinse step described above (step 2) is repeated and the apparatus is drained.

Step 4

There is added to the apparatus 5000 L of soap solution at 40°. This is heated to 95°, over a period of 30 minutes the apparatus is operated for 10 minutes and the solution allowed to cool to 60° over a period of 30 minutes and drained for 10 minutes (total time: 1 h 20 m).

Step 5

Step 3 is repeated.

Step 6

Step 3 is repeated with the temperature of the water at 30°.

Step 7

The material is removed from the dyeing apparatus (0.75 h), loaded into a centrifuge (0.5 h) and centrifuged for 10 minutes and removed from the centrifuge (0.5 h). It is then dried by conventional means.

The total duration of the above described process (excluding the drying step) is 7.4 h.

A comparison of Examples 1 and 2 reveals that the saving in the overall duration of the process is as a result of the reduction in the number of rinse (water) baths (and consequently in the overall water consumption of the dyeing process) required in Example 2 compared to the number (and overall water consumption) required in example 1. A further time saving occurs because it is unnecessary to heat up and cool down the rinse (water) baths at each processing step in Example 1. Only the soap-bath (heated to 98° C. in the storage tank) requires heating (the rinse (water) baths are the temperature of normal hot water and do not require cooling). This saving in heating and cooling results in an overall saving in energy requirements compared to the overall energy requirement of Example 2. An estimation of the water consumption shows that dyeing 500 Kg of cotton tricot according to Example 1 requires approximately 18.1 $m^3$ water, whereas Example 2 requires approximately 23.7 $m^3$ water. Moreover, costing the processes (using material, energy and labour costs valid for Basel, Switzerland, September 1995) reveals that the process according to the present invention is over 30% cheaper than the conventional process. This is an outstanding saving, especially as the dyeings were equal in performance. Moreover, the expensive dyeing apparatus is freed for use in further dyeings and is not occupied by treatment stages.

Example 3

Figure 4:
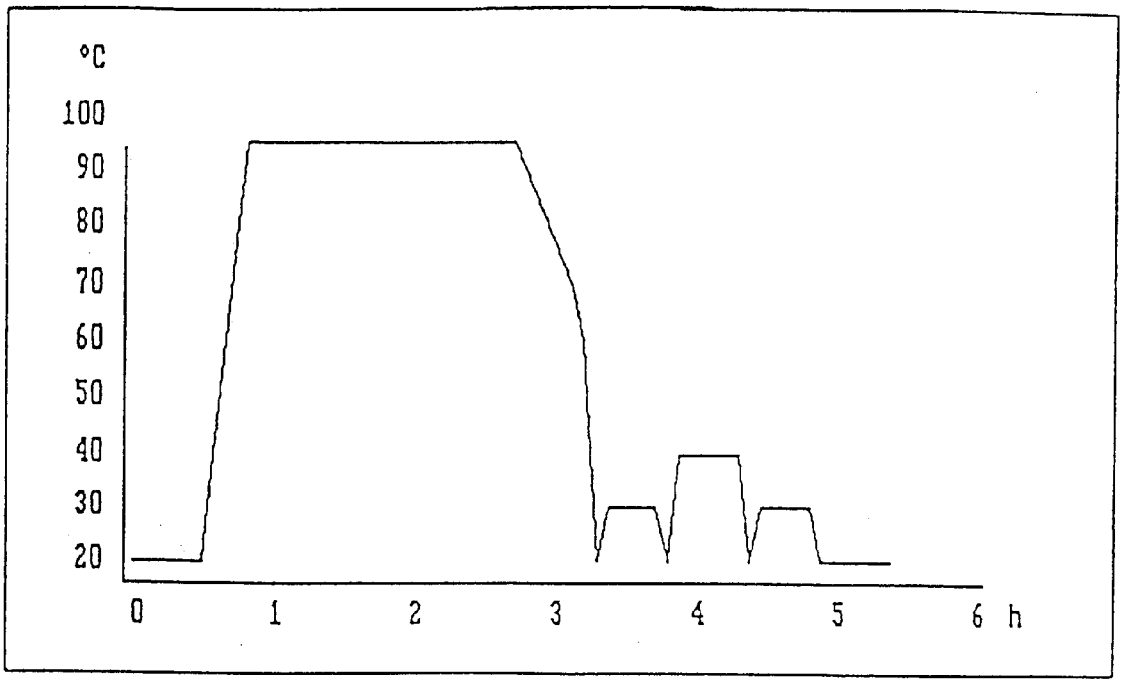
FIG. 4 is a temperature vs. time curve for the process of the present invention, described in Example 3

An example of a direct dye, applied according to the invention. The process according to this example is illustrated in FIG. 4

500 Kg cotton interlock is dyed at 95° C. using a dyeing liquor having a goods to liquor ratio of 1:10, comprising 15 Kg "Optisal" (trade mark) Royal Blue 3RL SGR and 60 Kg Glauber salt in 5000 L water. An overflow dyeing apparatus of the type described in Example 1 is used to perform the dyeing. Dyeing, including loading of the dyeing apparatus, is carried out for 3.3 h. The specific steps of the process after dyeing has been completed, comprise:

1. transfer to a centrifuge as hereinabove described and centrifuging;
2. rinsing at 25° C. with 5000 L cold hard water for 10 min. and centrifuging;
3. treating with a fixing solution for 20 minutes at 40° C. and centrifuging,
4. neutralizing with a solution comprising 5000 L hard water and 15 L acetic acid, at 25° and centrifuging.

After centrifuging, the fabric is removed from the centrifuge (0.5 h) and dried by conventional means.

Each of the centrifuging steps lasts 5 minutes.

The fixing solution used is:

5000 L soft water

15 Kg "Sandolub" (trade mark) JNF liquid (fabric softener)

30 Kg "Optifix" (trade mark) F liquid (fixing agent)

1 Kg "Antimussol" (trade mark) SF liquid (antifoam)

25 sodium hydroxide 36° Bé

Fixing is carried out for 0.33 h.

The total process time is 5.4 hours.

Example 4

Figure 5:
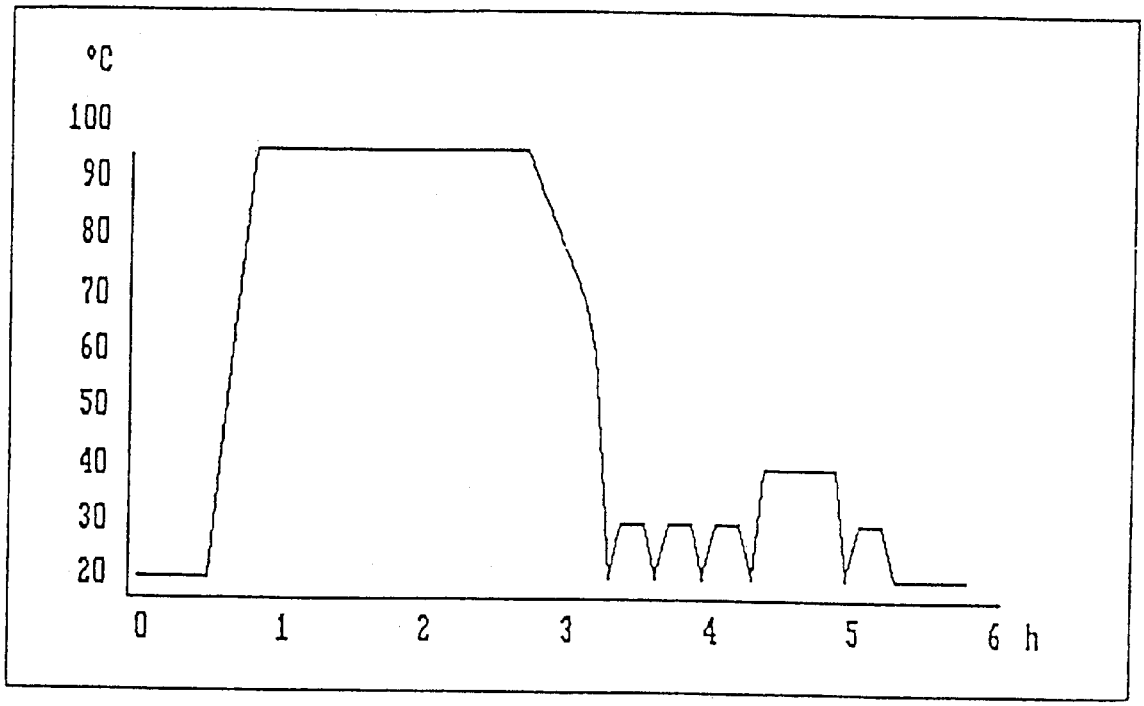
FIG. 5 is a temperature vs. time curve for the process of the present invention, described in Example 4

The process according to this example is illustrated in FIG. 5. 500 Kg cotton interlock is dyed at 95° using a conventional dyeing process and the dye liquor of example 3. Dyeing was carried out in the same apparatus as used for Example 1 and under the same conditions and for the same period of time. After dyeing, the process is as follows:

1. the dyeing apparatus is drained, the dyed goods are rinsed for 10 minutes at 40° with cold hard water and the apparatus is drained;
2. 5000 L of hard water at 25° is added to the apparatus, the goods are rinsed for 10 minutes and the apparatus drained;
3. step 2 is repeated;
4. 5000 L of the fixing liquid hereinabove described is added to the apparatus and the goods are treated for 10 minutes at 40° C., after which the apparatus is again drained;
5. 5000 L water containing 15 L acetic acid is added to the apparatus, the apparatus is run for 10 minutes and it is then drained;
6. the goods are removed from the apparatus, loaded into a centrifuge and centrifuged for 5 minutes.

The total process time is 5.8 hours.

A comparison of Examples 3 and 4 reveals that the operation according to the present invention, is somewhat shorter in process time, but that several wash stages may be omitted with a consequent saving in water and labour. Calculated on the same basis as the Example 1–Example 2 comparison, the process of the present invention results in a cost savings of the order of 15%.

What is claimed is:

1. A dyeing process which comprises the steps of applying a dyeing liquor to a fabric to be dyed in a conventional dyeing machine, and thereafter subjecting the fabric to a treatment regime carried out in a centrifuge distinct from the conventional dyeing machine, the treatment regime comprising a series of liquid bath treatment steps and centrifugation, wherein the centrifugation is carried out after each said liquid bath treatment step.

2. A dyeing process as claimed in claim 1, wherein as a treatment step is taking place, the treatment liquid is continuously recycled through the centrifuge.

3. A dyeing process comprising the following sequential steps:

providing a fabric to be dyed;

dyeing said fabric;

centrifuging said fabric;

rinsing said fabric in a bath;

centrifuging said fabric;

immersing said fabric in a soap bath;

centrifuging said fabric;

rinsing said fabric in a bath; and centrifuging said fabric;

wherein the dyeing takes place in a conventional dyeing machine and the subsequent steps take place in a treatment vessel comprising a centrifuge, the treatment vessel comprising the centrifuge being distinct from the conventional dyeing machine.

* * * * *